United States Patent [19]

Pollock

[11] 4,037,380

[45] July 26, 1977

[54] INTERIOR PARTITION STRUCTURE WITH RESILIENTLY-BIASED PANELS

[76] Inventor: Gordon J. Pollock, 2039 Wooster Rd. No. 45, Rocky River, Ohio 44116

[21] Appl. No.: 653,550

[22] Filed: Jan. 29, 1976

[51] Int. Cl.[2] ..... E04B 2/82; E04B 2/76

[52] U.S. Cl. ..... 52/483; 52/122; 52/238; 52/300

[58] Field of Search ..... 52/242, 238, 241, 586, 52/403, 122, 300, 483, 243, 233

[56] References Cited

U.S. PATENT DOCUMENTS

| | | | |
|---|---|---|---|
| 1,975,470 | 10/1934 | McInerney | 52/238 |
| 2,076,388 | 4/1937 | Venzie | 52/242 |
| 2,078,620 | 4/1937 | Venzie | 52/238 |
| 3,339,324 | 9/1967 | Stackhouse | 52/241 |
| 3,353,318 | 11/1967 | Bacher | 52/403 |
| 3,364,641 | 1/1968 | Brenneman | 52/396 |
| 3,453,790 | 7/1969 | Harris | 52/241 |
| 3,641,730 | 2/1972 | Meckstroth | 52/586 |
| 3,707,060 | 12/1972 | Jansen | 52/241 |

FOREIGN PATENT DOCUMENTS

| | | | |
|---|---|---|---|
| 1,013,395 | 12/1965 | United Kingdom | 52/243 |
| 570,589 | 12/1957 | Italy | 52/243 |

*Primary Examiner*—James L. Ridgill, Jr.
*Attorney, Agent, or Firm*—Isler & Ornstein

[57] ABSTRACT

A multi-panel partition structure for creating a space enclosure in a building, which enclosure can be free-standing or have its terminal portions secured to the fixed walls of the building. The panels are mounted in coplanar abutting relationship between vertically extending, horizontally-spaced support posts and rest upon a base which extends between each pair of posts. A header-piece, which is fixed relatively to the upper end of the posts at a predetermined height, is provided with resilient spring means which bias the panels into yieldable abutment with the base. Resilient joint-sealing means between the laterally adjacent edges of the panels bias the panels into abutment with each other and with the support posts. The panels are not secured to each other nor to the base, head-piece or posts. The base, the head-piece and, preferably, the posts each comprise two telescopically overlapping portions which are slidably movable relatively to each other so as to permit proper positioning and leveling of the panels independently of the grade or tilt of the floor, walls or ceiling of the building.

15 Claims, 17 Drawing Figures

INTERIOR PARTITION STRUCTURE WITH RESILIENTLY-BIASED PANELS

BACKGROUND OF THE INVENTION

Partition structures are commonly utilized to form semi-permanent or movable space enclosures within a larger fixed area, space or room of a building structure. The partition walls can either extend from floor to ceiling or can be of lesser height. Pre-dimensioned stock sizes of modular panels are ordinarily used, which are generally made of a metal which can be formed, such as steel sheet, in which the edges can be bent and formed to provide suitable arrangements for fixedly securing adjacent panels to each other and to support posts, base supports and head-pieces. Due to irregularities or deviations from plumb in the permanent walls of buildings and irregularities or deviations from horizontal in the floor and ceilings of such buildings. the stocks sizes of the partition components must be modified to accommodate to such deviations. in view of the rigid or fixedly secured characteristic of the structure when it is installed or erected. The fabrication of the components must await the completion of the building before on-site measurements can be taken to establish the proper size of the panel units. This not only results in considerble delay in the completion of the partition installation, but also involves considerable expense in taking measurements at the building site and sizing the components to custom fit the site. Steel panel partition structures have a tendency to vibrate and readily transmit noise, but do have the advantage of flexibility in the sense that they ordinarily can be disassembled and rearranged or reused without any great likelihood of damage.

Partition structures made of gypsum board which is cut to size and installed at the site, also requires the use of metal components to secure the panels to each other and to the support elements. However the gypsum partition structure cannot conveniently be disassembled and rearranged as its requires disassembly and reassembly of many metal components, which may have to be modified to a considerable extent in any rearrangement of the partition structure. Furthermore, as the gypsum is a relatively soft, composition panel, the gypsum board is easily damaged upon disassembly and reassembly and frequently has to be replaced with new board in any such rearrangement.

SUMMARY OF THE INVENTION

The invention contemplates a partition structure which can utilize preassembled unit panels of non-formable material, such as gypsum, composition board, pressed wood, laminated and veneered surfaces and the like. The delay and expense encountered in taking building site measurements, as is necessary with steel partition structures, is avoided as the panels are not rigidly or fixedly secured to each other and to the support elements, but instead the support elements are designed to accomodate to the ordinary deviations in the walls, floors and ceilings, thus permitting each wall section to be positioned in conformity with, but independently of, the other wall sections of the enclosure. Springs or other resilient elements are utilized to maintain the panels in yieldably compressed abutment with each other and with the support components, so that no fixed securement is required and the panels can be disassembled without disassembly of numerous fastening devices.

The panels themselves are provided with a peripheral reenforcement which minimizes the risk of damaging these non-formable composition panels both in initial installation and in any subsequent rearrangement which is desired. Thereby, the advantages of ease of rearrangement of the steel partition structure are retained and the disadvantages of the steel panel system are avoided.

DESCRIPTION OF THE PREFERRED EMBODIMENTS

Figure 1:
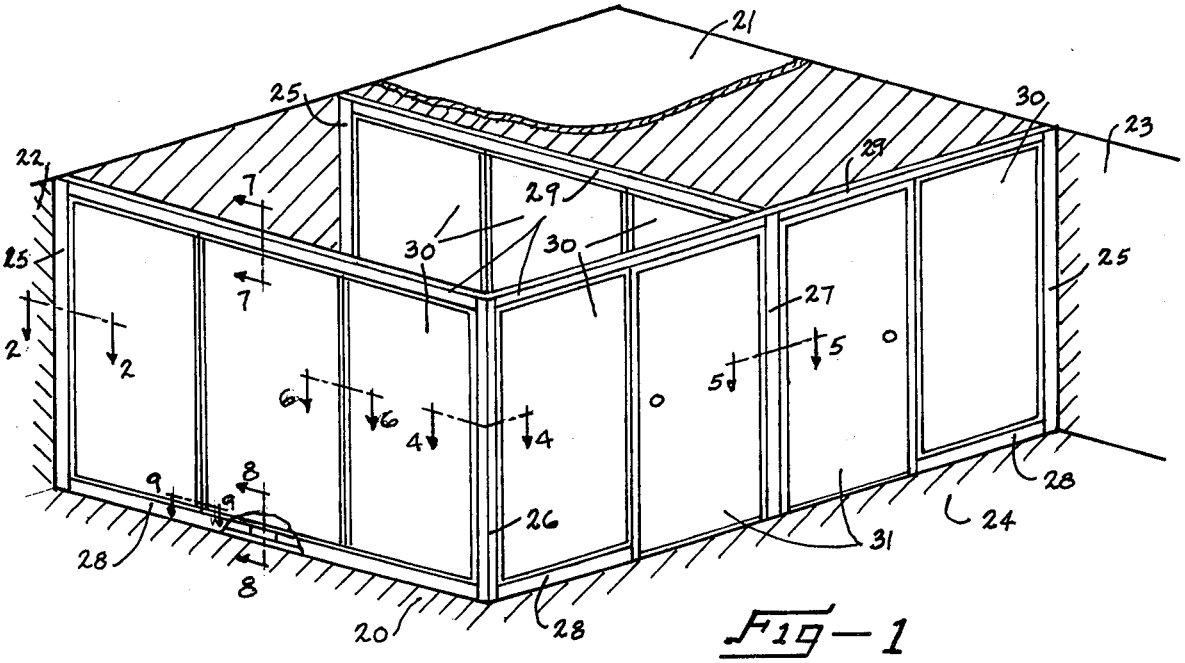
FIG. 1 is an isometric view of a representative interior partition structure embodying the features of the invention.

Referring to FIG. 1 of the drawings, there is shown an interior space or chamber of a building having a floor 20, a ceiling 21 and intersecting fixed walls 22 and 23. A portion of the building room or chamber is isolated and enclosed by means of a multi-panel partition structure designated generally as 24. For purposes of illustration, the partition structure 24 is shown as being in abutment with the fixed walls and the floor and ceiling of the building chamber, but as will appear more fully hereinafter, the enclosure need not extend to the height of the ceiling 21 nor need it necessarily abut any of the fixed walls.

The partition structure 24 includes the wall-abutting terminal uprights or posts 25, the corner post 26 and an intersection post 27 which defines the periphery of the enclosure. A panel-supporting base 28 extends between each adjacent pair of posts and rests upon or engages the floor. A head-piece 29 extends horizontally between each adjacent pair of posts and is secured relatively to the posts at a predetermined height above floor level which, in the illustration of FIG. 1, is shown as ceiling level.

Between each pair of posts are mounted a plurality of prefabricated panel assemblies 30 which are disposed in coplanar relationship with each other between each pair of adjacent posts and are yieldably retained between the head-piece 29 and the base 28. If desired, a door 31 or other modified panel equivalent can be substituted for one or more of the panels 30.

Each of the posts 25, 26 and 27 is of two-piece tubular design and includes a U-shaped, longitudinally extending interior section 32 which nests in and is slidably received in a complementary, longitudinally extending, U-shaped exterior section 33. It is to be noted that, as thus far described, the posts 25, 26 and 27 are identical and interchangeable with each other. In a free-standing partition enclosure which is not in abutment with any of the walls of the building chamber, the terminal posts 25 would be the same as the corner posts 26, as will more fully appear hereinafter. However, when the partition enclosure is in abutment with the fixed walls of the chamber of the building, as shown in FIG. 1, it is desirable that the terminal posts 25 have a slightly modified form of interior section 35 wherein the web of the U-shaped interior section is formed with a longitudinally extending pocket or recess 35 which is slit to provide a pair of retaining lance or clip portions 36 which can be deformed to retain the base of a compression coil spring 37 whose opposite end reacts against the web of the exterior section 33 of the post 25. The recess 35 serves to accommodate a longitudinally extending resilient sealing strip 38 which engages and seals against the fixed wall of the building chamber when the posterior section 34 of the terminal post 25 is abutted against the fixed wall. Preferably, two or more of the springs 37 are utilized within the terminal post 25 to yieldably displace the anterior section 33 of the post outwardly into abutment with the edge of the immediately adjacent panel 30. If desired, the posterior section 34 of the post 25 can be secured by suitable fasteners to the fixed wall of the building.

Figure 2:
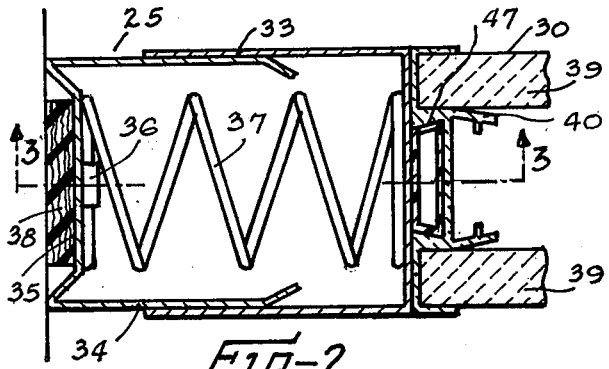
FIG. 2 is an enlarged cross-sectional view, taken as indicated on line 2 of FIG. 1 and showing the structure of a terminal support post.
Figure 4:
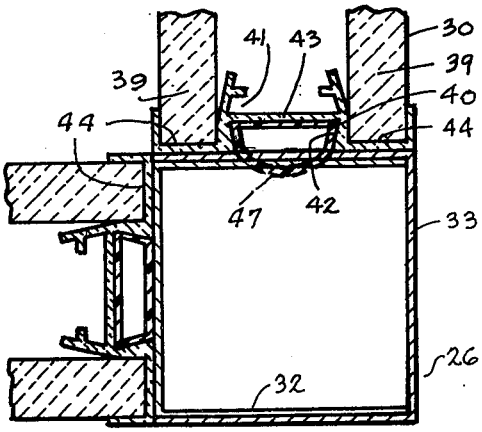
FIG. 4 is an enlarged cross-sectional of a corner support post, taken as indicating on line 4—4 of FIG. 1.
Figure 3:
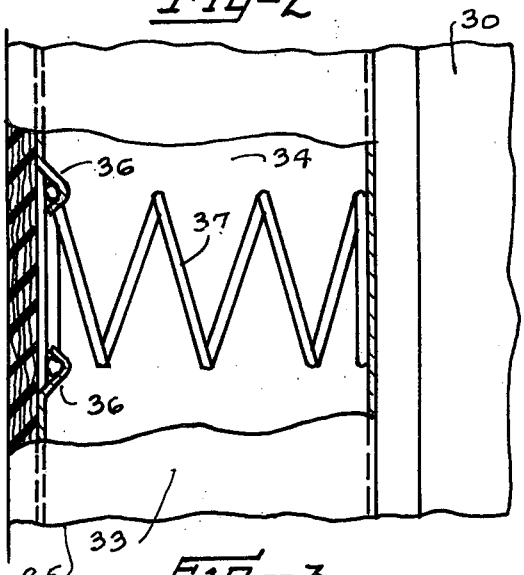
FIG. 3 is a cross-sectional view, taken as indicated on line 3—3 of FIG. 2.
Figure 5:
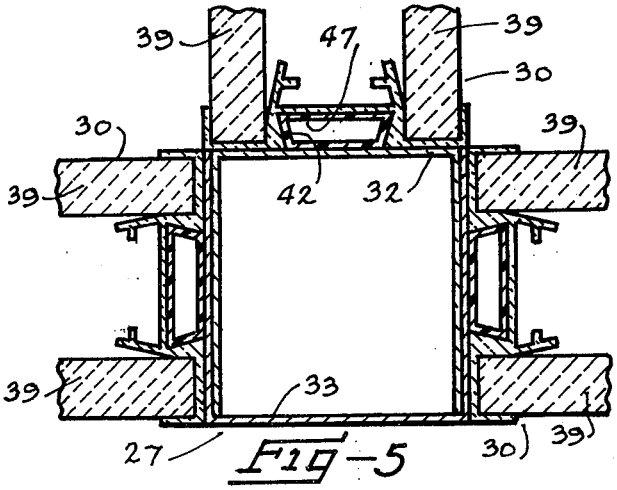
FIG. 5 is an enlarged cross-sectional view of an intersection support post, taken as indicated on line 5—5 of FIG. 1.
Figure 6:
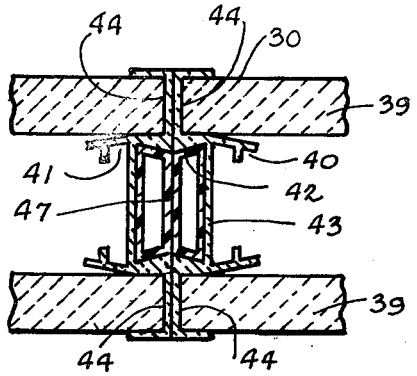
FIG. 6 is an enlarged cross-sectional view of the joint between adjacent partition panels, taken as indicated on line 6—6 of FIG. 1.
Figure 9:
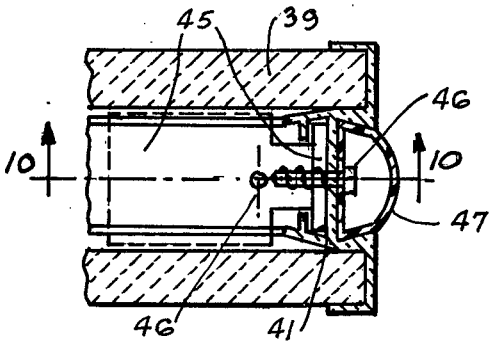
FIG. 9 is an enlarged cross-sectional view showing details of the reinforcing strip of a partition panel, taken as indiciated in line 9—9 of FIG. 1.
Figure 10:
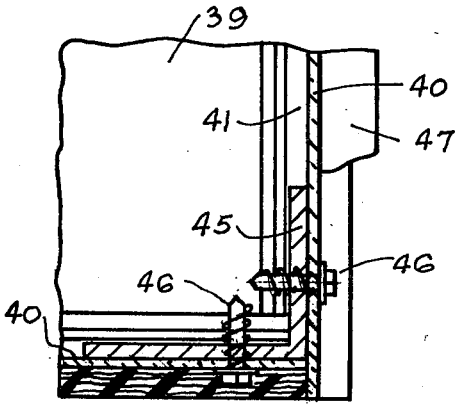
FIG. 10 is a cross-sectional view, taken as indicated on line 10—10 of FIG. 9.

As best seen in FIGS. 4 and 5, each of the panels 30 comprises two spaced rectangular pieces 39 of gypsum board or other non-formable material of the type previously indicated, which are maintained in predetermind spaced relationship to each other by means of a reinforcing strip 40 which extends and is secured to each edge of the pair of spaced panel pieces 39. The reinforcing strip 40 is preferably a metal extrusion which, in cross-section, is provided with a pair of dovetail recesses 41 and 42 which extend to opposite sides of a common web 43. Projecting laterally from the web 42 are a pair of longitudinally extending oppositely disposed pair of channels 44 which are sized to receive the thickness of the panel piece 39 and frictionally grip it. For the rectangular pieces 39 which are illustrated, one of the reinforcing strips 40 would be provided for each of the four edges of the piece. As best seen in FIGS. 9 and 10, each of the reinforcing strips 40 is joined to its adjacent intersecting strips at the corners of the piece 39 by means of an angle clip 45, received in the dovetail 41, and the threaded fasteners 46. The externally facing dovetail 42 of the panel assembly is adapted to slidably receive and retain a formed, tubular, resilient gasket strip 47 which is provided on the vertically extending laterally adjacent edges of the panel assemblies so as to resiliently engage and compress each other at the joints between adjacent panels, as shown in FIG. 6, as well as to resiliently be compressed against the surface of the posts, as shown in FIGS. 2, 4 and 5. Thus, when the panels 30 are disosed in coplanar relationship between the pairs of support posts, they are resiliently compressed into sealing engagement with each other and with the posts by means of the compressed gasket strips 47 in abutment at the joints of the panels and in abutment with the posts. When the terminal posts 25 are not in abutment with a fixed wall of the building, these resilient gasket strips provide the resilient component of lateral force holding the panels in compression. When the terminal posts 25 are affixed to a wall of the building and are spring loaded, as illustrated in FIGS. 2 and 3, then the action of the coil spring 37 provides an additional lateral component of force against the panels. However, the primary purpose of the spring 37 is to displace the anterior section 33 of the terminal post 25 into sealing abutment with the edge of the adjacent panel 30 regardless of irregularities or deviations from plumb that may exist in the fixed walls 22 or 23 of the building structure.

Figure 7:
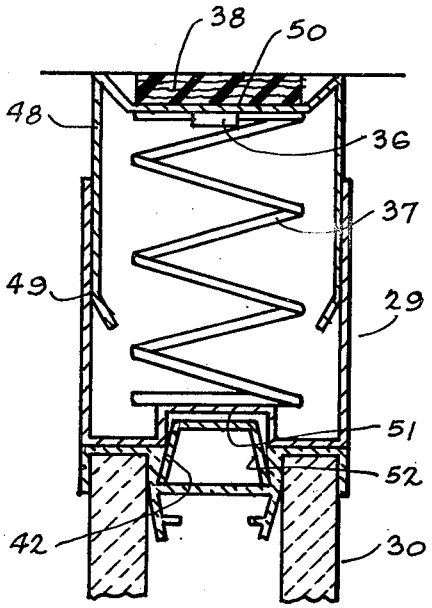
FIG. 7 is an enlarged cross-sectional view of the head-piece of the structure, taken as indicated on line 7—7 of FIG. 1.

As illustrated in FIG. 7, the horizontally extending head-peice 29 is similar to the terminal post 25, illustrated in FIG. 2, in having a longitudinally extending upper section 48 of U-shaped cross-section which is nested in and slidably received in a coextensive lower section 49 to U-shaped cross-section. The upper section is recessed at 50 to accommodate the previously described sealing strip 38 which is compressed and serves to seal the joint between the head-piece and the ceiling 21. The recess is slit to provide the deformable lances or clips 36 to anchor the base of a compression coil spring 37 whose other end reacts against the lower section 49 of the head-piece and displaces it downwardly into abutting engagement with the upper edge of each of the panels extending between the pair of adjacent posts. Preferably, at least two the springs 37 are provided in each run of head-piece 29. If desired, the upper section 48 of the head-piece can be secured by suitable fasteners to the fixed ceiling 21.

The lower section 49 of the head-piece has its web portion recessed inwardly, as at 51, to accommodate a metal or plastic aligner strip 52 which is tapered to be retained in the dovetail 42 in the reinforcing strip in the upper edge of the panel. The strip 52 projects into the recess 51 and serves to properly locate and align the upper edge of the panel with the head-piece 29. As in the case of the previously described terminal post, the lower section 49 of the head-piece is yieldably displaced into abutment with the upper edge of the panels, by means of the spring 37, independently of any irregularities or tilt in the fixed ceiling 21 which might cause the upper portion 48 to slant or deviate from a substantially true horizontal posture.

Figure 8:
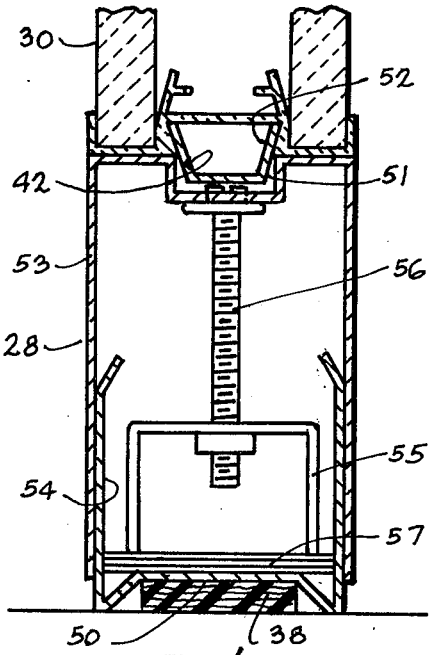
FIG. 8 is an enlarged cross-sectional view of the base of the structure, taken as indicated on line 8—8 of FIG. 1.

As best seen in FIG. 8, the support base 28 is provided with an upper section 53, similar to the previously described lower section 49 of the head-piece, and a lower section 54, similar to the previously described upper section 48 of the head-piece. The lower edge of the panel 30 is provided with an aligner strip 52, as previously described, which projects into a recess 51 in the web of the upper section 53 of the support base to locate and align the panels in coplanar relationship with respect to the support base and with respect to the head-piece.

Figure 12:
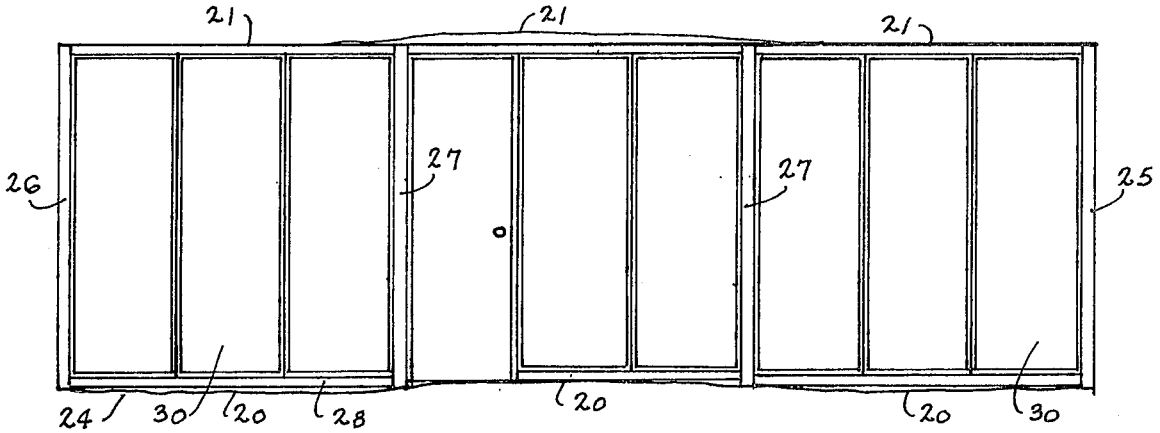
FIG. 12 is a view in elevation of a portion of the structure shown in FIG. 1, and indicating the floor and ceiling variations to which the structure must accommodate in a rpresentative installation.

Any suitable means may be provided for displacing the upper section 53 of the support base relatively to the lower section 54, so as to bring the upper section intoo parallelism with the head-piece and into aligned abutment with the lower edges of the panels 30, independently of any grade or irregularity or tilt of the floor 20, which is engaged by the lower section 54 of the base. In FIG. 8, such means has been shown as including one or more U-shaped saddle plates 55 which are supported within the lower section 54 of the base and provide a reaction surface for an adjusting screw 56 which is rotatably secured to the web of the upper section 53. Preferably, two or more of such adjusting means are provided in each run of the support base so that the upper section 53 can be raised into the desired horizontal position without regard to the tilt of the lower section 54. If the degree of irregularity or tilt of the floor 20 is so great as to be beyond the range of adjustment of the screw 56, the saddle plates 55 can be shimmed, as at 57 to elevate the saddle plate and the upper section 53 and bring it within the desired range of adjustment. If is to be noted that there is an independent run of the head-piece and of the support base between each pair of support posts, so that each run can be adjusted and positioned to accomodate to the pecularities of the floor and ceiling sections with which it is in contact, without necessarily influencing the adjustments that must be made to other conditions affecting other runs between pairs of posts. FIG. 12 of the drawings illustrates a representative enclosure wall and shows the variations in floor and ceiling deviations which can occur in different sections of the enclosure.

Figure 11:
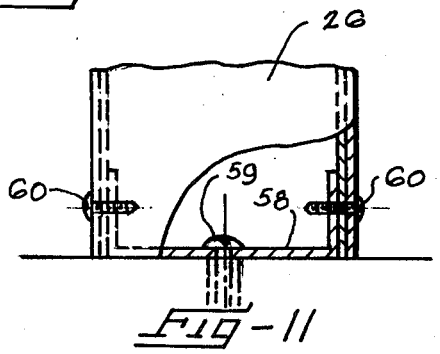
FIG. 11 is an enlarged fragmentary view in elevation of the lower portion of a corner post of the partition structure.

FIG. 11 illustrates the manner in which those support posts, such as the posts 26 and 27, which are not affixed to a fixed wall of the building, are secured to the floor 20. A U-shaped saddle clip 58, sized to fit inside the interior section 32 of the post, is anchored to the floor 20 by means of the fastener 59 after the proper location of the post has been determined. The two sections of the post are then assembled over the saddle clip and secured to each other and to the saddle clip by means of the lateral fasteners 60. When the posts extend from the floor to the ceiling, the same anchoring arrangement is used at the top of the posts to anchor them to the ceiling.

Figure 13:
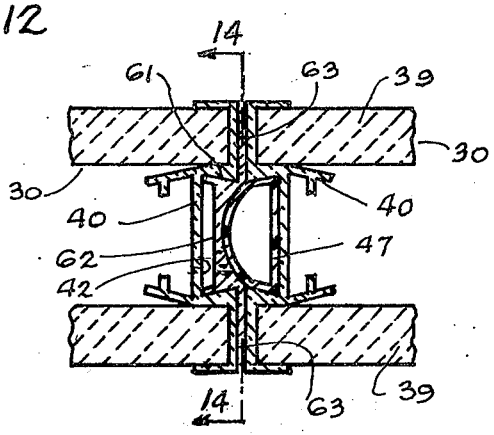
FIG. 13 is a cross-sectional view, similar to FIG. 6, but showning a modified form of joint between adjacent panels.
Figure 14:
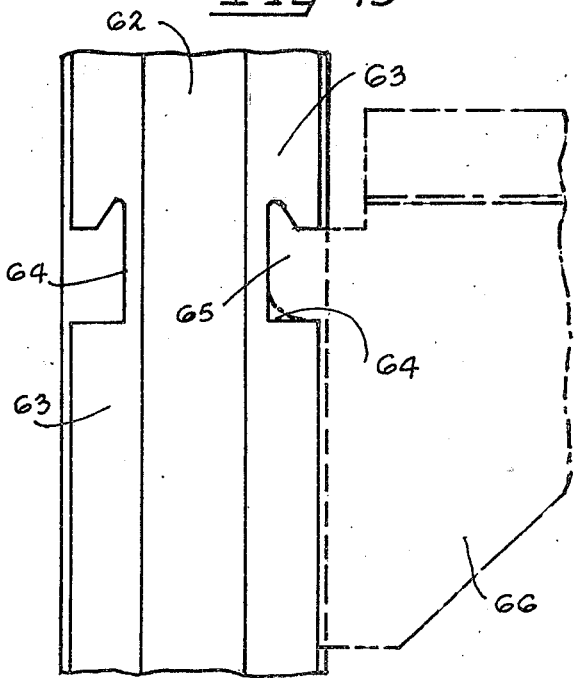
FIG. 14 is an enlarged cross-sectional view, taken as indicated on line 14—14 of FIG. 13.

FIGS 13 and 14 illustrate a modified form of joint which can be utilized, if desired, between adjacent panels 30. In this form, a spacer strip 61 is interposed between the vertical edges of adjacent panels 30 to provide a feature strip at the joint. The spacer strip 61 has a wedge-shaped central portion 62 which is slidably received and retained in the dovetail recess 42 on the vertically extending edge of one of the adjacent panels. A pair of flat, coplanar arms 63 project diametrically opposite to each other outwardly from the central wedge portion 62, so as to be disposed between adjacent exterior faces of the channel 44 of the reinforcing strips 40 on the respective panels 30. It is considered desirable that the outer ends of the arms 63 be short of the surfaces of the panels so as to define a vertically extending groove between the panels, which is characteristic of a feature strip of this kind. As best seen in FIG. 14. the arms 63 may be provided with vertically spaced notches 64 to accomodate the anchoring tongue 65 of a shelf bracket 66 or the like which can be disposed either interiorly of the enclosure or exteriorly of the enclosure or both. Such brackets 66 and the uses to which they are put are well known and require no further elaboration.

Figure 15:
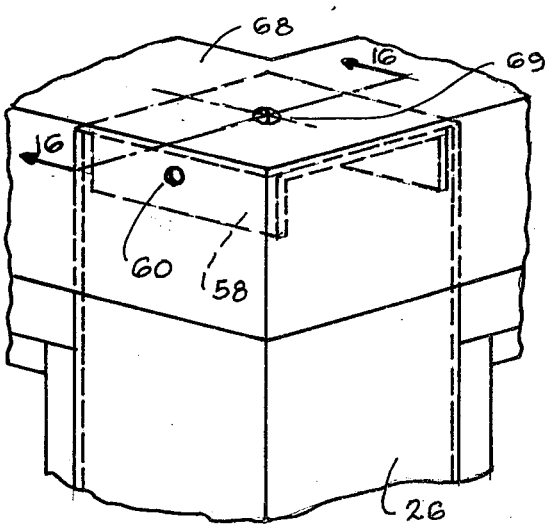
FIG. 15 is a fragmentary isometric view of the head-piece arrangement which may be utilized when the partition structure is less than ceiling height.
Figure 16:
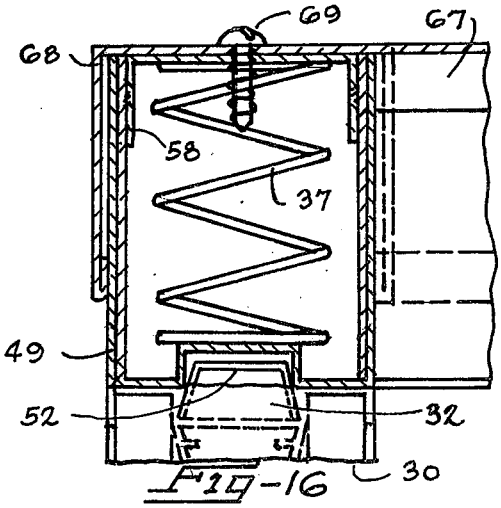
FIG. 16 is a cross-sectional view, taken as indicated on line 16—16 of FIG. 15.

FIGS. 15 and 16 of the drawings illustrate the form of securement used between the head-piece and the upper end of the support posts when the partition enclosure is less than ceiling height and the upper ends of the support posts terminate intermediate the ceiling 21 and the floor 20. In such case, as arrangement similar to that shown in FIG. 11 is used, utilizing the saddle clip 58 interiorly of the support post at the upper end thereof and securing it by means of laterally extending fasteners 60 to the support post. An inverted U-shaped cornice 67 is mounted to overlie and be secured to the upper section of the head-piece 29 and extend over the upper end of the support post. This is ordinarily conveniently accomplished by using an intersection connector 68 which may be a corner connector, as shown, or may be a three-way or four-way or in-line connector depending upon the circumstances. The connector 68 is merely a convenient extension of the cornice pieces 67 at their intersections at the upper end of the support post. The cornice or its connector 68 is secured to the upper end of the post by means of a fastener 69 extending through the cornice or connector and into the saddle clip 58 which is anchored to the post.

Figure 17:
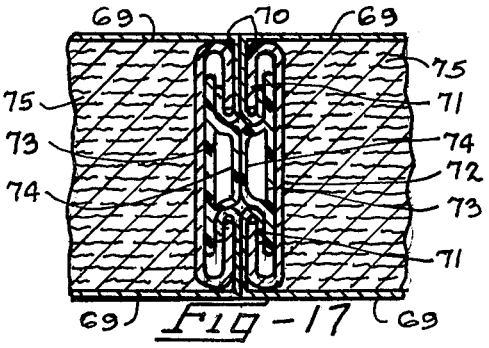
FIG. 17 is an enlarged cross-sectional view, similar to FIG. 6 and showing a modified form of joint utilized between adjacent steel panels of the partition structure.

FIG. 17 of the drawings illustrates a modification of the invention, in which the teachings of the invention are utilizied in connection with a steel panel structure. Spaced steel panel pieces 69 each have flanged and rebent end portions 70 which, in combination define outwardly and oppositely disposed recesses or channels 71 which are sized to slidably receive and retain a connector spline strip 72 which maintains the panel pieces in rigid predetermined spaced relationship to each other. A formed tubular gasket strip 73 is slidably accomodated between the main body of the spline strip 72 and the rebent ends 70 of the panel piece and has a resilient central projecting portion 74 which is adapted to abut and be compressed by a companion sealing joint arrangement on the edge of the adjacent panel assembly 75.

Referring back to the preferred embodiments shown in FIGS. 1–16 of the drawings, it will be evident that the erection of the disclosed partition enclosure is relatively uncomplicated and will taken a minimum of time and effort. The outline periphery of the partition enclosure is established by the location of the support posts, which locations must be first established regardless of whether the terminal posts of the enclosure are to be free standing or affixed to the building walls and regardless of whether the head-piece is to be ceiling high or at a lower intermediate position. After the support posts have been positioned and secured, the base and the head-piece are assembled between each pair of support posts. The upper section of the support base is then leveled and brought into parallelism with the head-piece. The modular, prefabricated panels are then successively inserted by raising the upper edge of each panel into the head-piece against the action of the spring 37 and then letting the bottom edge of the panel come to rest on the upper section of the base in response to the biasing effect of the spring. Similarly, where the terminal posts are spring loaded, a lateral edge of a panel is brought into abutment with the support post 25 in opposition to the action of its springs 37 and then the action of the spring 37 is permitted to bias and yieldably compress the panel into abutting engagement with the remaining panels running to the next support post.

Inasmuch as there are no clips or fasteners securing the panels to each other or to head-piece or to the posts or to the base, it is apparent that the panels can be eaily disassembled and the partition structure rearranged or reerected in another location. Although the panel pieces themselves are preferably made of non-malleable, non-formble materials of the sort previously enumerated, the use of the reinforcing strips to prefabricate the panel units provides adequate protection for the edges of the panel pieces so as to minimize the damage that might otherwise occur during the assembly and disassembly of easily injured materials such as gypsum.

It is to be understood that the forms of my invention, herewith shown and described, are to be taken as preferred examples of the same, and that various changes in the shape, size and arrangement of parts may be resorted to, without departing from the spirit of my invention, or the scope of the subjoined claims.

Having thus described my invention, I claim:

1. In a multi-panel partition structure for creating an enclosure in an interior chamber of a building, the combination of a plurality of vertical support posts extending upwardly from the floor of the chamber in predetermined horizontally spaced relationship to define the peripheral outline of the partition structure, a panel-support base extending between each adjacent pair of said support posts and engaging the floor of the chamber, a plurality of vertically extending partition panels resting on said base in yieldably compressed co-planar abuting relationship with each other between said support posts, but free from securement or attachment with each other or with said posts whereby each of said panels is movable into or out of said partition structure independently of any other panel and without dissassembly of any other element of said partition structure, said panels having parallel top and bottom edges, a head-piece extending horizontally between said support posts and secured relatively thereto at a predetermined height, and spring means carried by said head-piece and operatively engaging the top edges of said partition panels to bias said panels into yieldable compression abutment with said base.

2. A combination as defined in claim 1, wherein said top edges and said bottom edges of said panels are provided with aligning means for engagement with the head-piece and the base for positioning said panels in co-planar relationship thereon.

3. A combination as defined in claim 1, wherein at least two of said support posts are provided with second spring means operatively engaging the lateral edges of the adjacent abutting panels to bias said panels into yieldable compression abutment with each other.

4. A combination as defined in claim 3, wherein each of said two support posts is mounted adjacent a fixed wall of said interior chamber.

5. A combination as defined in claim 4, wherein each of said two posts comprises a longitudinally extending wall-engaging posterior section and a longitudinally extending panel-engaging anterior section in slidably telescoped overlapping relationship to each other, and said second spring means displaces said anterior section into coextensive abutment with the edge of the adjacent partition panel independently of any wall-induced tilt of said posterior section.

6. A combination as defined in claim 1, wherein said head-piece comprises a longitudinally extending upper section and a longitudinaly extending lower section adjacent the top edges of said panels, said section being slidably telescoped in overlapping relationship for relative movement, and said spring means engages said lower section to yieldably displace it into retaining abutment with the top edges of said partition panels.

7. A combination as defined in claim 6, wherein said posts extend between the floor and ceiling of said chamber, and said head-piece is secured at ceiling level.

8. A combination as defined in claim 6, wherein the upper ends of said posts terminate intermediate the floor and the ceiling of said chamber, and said head-piece is secured to the upper ends of said posts.

9. A combination as defined in claim 1, wherein the lateral abutting edges of said partition panels include resilient joint-sealing means biasing said panels laterally into yieldable compression abutment with each other and with said posts.

10. A combination as defined in claim 1, including means provided on said base for elevating the bottom edges of said panels to a common substantially horizontal plane parallel to said head-piece independently of any floor-induced tilt in said base.

11. A combination as defined in claim 10, wherein said base comprises a longitudinally extending upper section adjacent the bottom edge of said panels and a longitudinally extending lower section engaging said floor, said upper section being moveable relatively to said lower section, and said means for elevating said panels engaging said upper section to effect selective displacement thereof relatively to said lower section.

12. A combination as defined in claim 11, wherein said upper and lower sections of said base are slidably telescoped in overlapping relationship.

13. A combination as defined in claim 9, wherein said panels are of a non-formable material, each of said panels is provided with a peripheral reinforcing strip of different material extending therearound, and said reinforcing strip carriers said resilient joint-sealing means.

14. A combination as defined in claim 13, wherein said reinforcing strip comprises a central longitudinally extending dovetail recess having outwardly convergent walls, and said resilient joint-sealing means comprises an elastomeric gasket of complementary dovetail configuration retained in said recess in at least one of the lateral edges of a panel.

15. A combination as defined in claim 14, wherein at least one panel of a pair of adjacent panels is provided with said elastomeric gasket, the edge of the adjacent panel of said pair is provided with a spacer strip having a complementary dovetail portion slidably engageable with said dovetail recess in the adjacent panel and having wing portions extending between said adjacent laterally extending edges of said pair of panels, said spacer strip being in abutment with said gasket, and said wing portions having recesses provided therein for detachable securement thereon of brackets projecting outwardly of and normal to said panels.

* * * * *